US010978040B2

(12) United States Patent
Isberg et al.

(10) Patent No.: US 10,978,040 B2
(45) Date of Patent: Apr. 13, 2021

(54) SPECTRUM MATCHING IN NOISE MASKING SYSTEMS

(71) Applicant: Sony Corporation, Tokyo (JP)

(72) Inventors: Peter Isberg, Lund (SE); Kjell Krona, Lund (SE); Anci Johansson, Lund (SE); Richard Folke Tullberg, Eslöv (SE)

(73) Assignee: Sony Network Communications Europe B.V., Hoofddorp (NL)

( * ) Notice: Subject to any disclaimer, the term of this patent is extended or adjusted under 35 U.S.C. 154(b) by 0 days.

(21) Appl. No.: 16/828,415

(22) Filed: Mar. 24, 2020

(65) Prior Publication Data

US 2020/0312294 A1 Oct. 1, 2020

(30) Foreign Application Priority Data

Mar. 25, 2019 (SE) ..... 1930093-8

(51) Int. Cl.
*G10K 11/178* (2006.01)

(52) U.S. Cl.
CPC .. *G10K 11/17823* (2018.01); *G10K 11/17873* (2018.01); *G10K 2210/1081* (2013.01); *G10K 2210/3047* (2013.01)

(58) Field of Classification Search
CPC ..... G10K 11/17823; G10K 11/17873; G10K 2210/1081; G10K 2210/3047
USPC ..... 381/71.1
See application file for complete search history.

(56) References Cited

U.S. PATENT DOCUMENTS 10,609,468 B2 * 3/2020 Farahanisamani ..... G10K 11/17873

* cited by examiner

*Primary Examiner* — Paul Kim
(74) *Attorney, Agent, or Firm* — Renner, Otto, Boisselle & Sklar, LLP

(57) ABSTRACT

A device and method generate a sound masker to mask sound of the ambient environment. More specifically, spectral characteristics of sound in the ambient environment are determined, where the spectral characteristics are determined in terms of auditory excitation patterns. A database of pre-recorded sounds is searched to identify at least one pre-recorded sound that has spectral characteristics corresponding to the spectral characteristics of the sound in the ambient environment. At least a portion of the identified at least one pre-recorded sound is reproduced to mask the sound in the ambient environment.

20 Claims, 6 Drawing Sheets

SPECTRUM MATCHING IN NOISE MASKING SYSTEMS

CROSS-REFERENCE TO RELATED APPLICATIONS

This application claims priority to Swedish Patent Application No. 1930093-8 filed on Mar. 25, 2019, which is hereby incorporated herein by reference.

FIELD OF INVENTION

The present disclosure relates to noise masking and, more particularly, to a device and method that utilizes adaptive and personalized sound to mask noise in the ambient environment.

BACKGROUND OF THE INVENTION

In open areas, such as office environments, lobbies, etc., people may be disturbed by ambient noise (e.g., other people speaking). One way in which this problem is addressed is to use noise cancelling headphones. A problem with such noise canceling headphones is that for long use sessions they are not the most comfortable devices to wear. This is due in part to their closed (and often circum-aural or supra-aural) design, which can interfere with eye glasses and tend to retain heat.

Another way in which ambient noise may be addressed is to use masking-noise loudspeakers. These speakers are typically configured to play fixed noise having a speech-like spectrum. With such systems, however, it can be difficult to precisely tailor the masking noise to that of the ambient environment. Further, high levels of masking noise may be just as annoying as the ambient noise itself and thus the appropriate amount noise must be carefully used at a given time, but not more.

SUMMARY OF THE INVENTION

A device and method in accordance with the present disclosure utilize adaptive and personalized masking sound as a masker for noise in the ambient environment. Such masking sound, which for example may be output from speakers of a headphone or from loudspeakers arranged in the ambient environment, is derived from pre-recorded sounds, e.g., music, nature sounds, etc. More specifically, the ambient noise is analyzed to identify and/or predict spectral characteristics, and those spectral characteristics are used to search a database of pre-recorded sounds. One or more pre-recorded sounds having the same or similar spectral characteristics then are retrieved and output to mask the sound in the ambient environment. Further, use of pre-recorded comfortable sounds that have an appropriate spectral shape, considering the current acoustic situation, can minimize any disturbance to individuals in the immediate area. The level of masking noise also can be adjusted such that masking or partial masking is achieved. Fade-in, fade-out and cross-fade between sounds can be used to make the masker as unobtrusive as possible.

According to one aspect of the invention, a method of generating a sound masker includes: determining spectral characteristics of sound in the ambient environment, wherein said spectral characteristics are determined in terms of auditory excitation patterns; predicting future spectral characteristics of the sound in the ambient environment based on the determined spectral characteristics; searching a database of pre-recorded sounds to identify at least one pre-recorded sound that has spectral characteristics corresponding to the spectral characteristics of the sound in the ambient environment, e.g., a first pre-recorded sound and identifying at least one pre-recorded sound that has spectral characteristics corresponding to the predicted future spectral characteristics of the sound, e.g., a second pre-recorded sound; and reproducing at least a portion of the identified at least one pre-recorded sound, e.g., the first pre-recorded sound and/or the second pre-recorded sound, to mask the sound in the ambient environment.

In one embodiment, determining the spectral characteristics in terms of auditory excitation patterns includes using a hearing model and iteratively finding a gain that produces critical band excitation.

In one embodiment, the method includes predicting future spectral characteristics of the sound in the ambient environment based on the determined spectral characteristics, wherein searching the database of pre-recorded sounds includes identifying at least one pre-recorded sound that has spectral characteristics corresponding to the predicted future spectral characteristics of the sound.

In one embodiment, predicting includes basing the prediction on ambient sound collected over a predefined interval.

In one embodiment, reproducing the at least one pre-recorded sound includes outputting the pre-recorded sound through speakers arranged in the ambient environment or through speakers of a headphone.

In one embodiment, the method includes implementing at least one of looping of the identified at least one pre-recorded sound, cross-fading of the identified at least one pre-recorded sound, or level adjustment of the at least one pre-recorded sound.

In one embodiment, the method includes adjusting an output level of the identified at least one pre-recorded sound to produce partial or full masking of the sound in the ambient environment.

In one embodiment, determining spectral characteristics of the sound in the ambient environment comprises determining the spectral characteristics based on spectral analysis of the sound in the ambient environment.

In one embodiment, searching includes obtaining spectral characteristics of the pre-recorded sound, and comparing the spectral characteristics of the pre-recorded sound to the spectral characteristics of the sound in the ambient environment.

In one embodiment, searching the database comprises searching a database that includes at least one of pre-recorded music or pre-recorded nature sounds.

In one embodiment, searching the database that includes pre-recorded music includes searching a database of a subscription music service.

In one embodiment, the method includes implementing a noise-canceling function.

In one embodiment, the method includes adjusting a spectral shape of the at least one pre-recorded sound to match a target spectrum.

According to another aspect of the invention, a device for masking sound in the ambient environment includes: at least one audio input device operative to record sound from the ambient environment; a controller operatively coupled to the at least one audio input device, the controller configured to determine spectral characteristics of sound in the ambient environment collected by the at least one audio input device, wherein said spectral characteristics are determined in terms of auditory excitation patterns, predict future spectral characteristics of the sound in the ambient environment based on the determined spectral characteristics, and search a database of pre-recorded sounds to identify at least one pre-recorded sound that has spectral characteristics corresponding to the spectral characteristics of the sound in the ambient environment, e.g., a first pre-recorded sound, and at least one pre-recorded sound that has spectral characteristics corresponding to the predicted future spectral characteristics of the sound, e.g., a second pre-recorded sound.

In one embodiment, the controller is configured to determine the spectral characteristics in terms of auditory excitation patterns using a hearing model and an iteratively found gain that produces critical band excitation.

In one embodiment, the controller is configured to: predict future spectral characteristics of the sound in the ambient environment based on the determined spectral characteristics; and search the database of pre-recorded sounds to identify at least one pre-recorded sound that has spectral characteristics corresponding to the predicted future spectral characteristics of the sound.

In one embodiment, the controller is configured to base the prediction on ambient sound collected over a predefined interval.

In one embodiment, the device includes at least one audio output device operatively coupled to the controller and operative to output sound, wherein the controller is configured to use the at least one audio output device to reproduce at least a portion of the identified at least one pre-recorded sound to mask the sound in the ambient environment.

In one embodiment, the controller is configured to determine spectral characteristics of the collected sound based on spectral analysis of the collected ambient sound.

In one embodiment, the controller is configured to implement cross-fading of the identified at least one pre-recorded sound.

In one embodiment, the controller is configured to adjust an output level of the identified at least one pre-recorded sound to produce partial or full masking of the sound in the ambient environment.

In one embodiment, the device comprises noise cancelling headphones.

In one embodiment, the controller is configured to search a database that includes at least one of pre-recorded music or pre-recorded nature sounds.

In one embodiment, the at least one audio output device comprises a speaker.

In one embodiment, at least one of the at least one audio input device or the at least one audio output device is remote from the controller.

In one embodiment, the controller is configured to adjust a spectral shape of the at least one pre-recorded sound to match a target spectrum.

These and further features of the present disclosure will be apparent with reference to the following description and attached drawings. In the description and drawings, particular embodiments of the disclosure have been disclosed in detail as being indicative of some of the ways in which the principles of the disclosure may be employed, but it is understood that the disclosure is not limited correspondingly in scope. Rather, the disclosure includes all changes, modifications and equivalents coming within the spirit and terms of the claims appended hereto. Features that are described and/or illustrated with respect to one embodiment may be used in the same way or in a similar way in one or more other embodiments and/or in combination with or instead of the features of the other embodiments.

DETAILED DESCRIPTION

Figure 1:
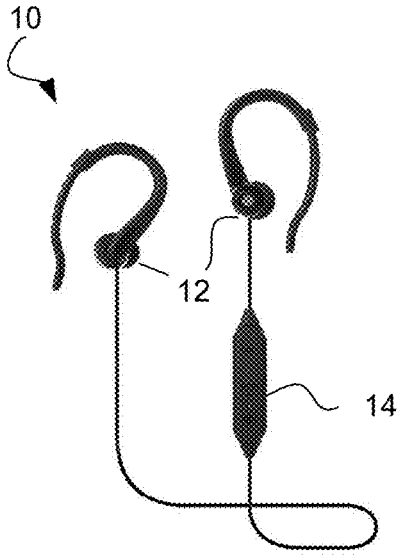
FIG. 1 illustrates an example headphone that includes a masking function in accordance with the present disclosure.

Embodiments of the present disclosure will now be described with reference to the drawings, wherein like reference numerals are used to refer to like elements throughout. It will be understood that the figures are not necessarily to scale.

The present disclosure finds utility in headphones and thus will be described chiefly in this context. However, aspects of the disclosure are also applicable to other sound systems, including portable telephones, personal computers, audio equipment, and the like.

Referring initially to FIG. 1, illustrated is an example headphone 10 to which principles in accordance with the present disclosure may be applied. In an embodiment, the headphone 10 has an open design in which earbuds 12 are arranged relative to a user's ear but do not cover the entire ear. Such open configuration is useful as it generally provides a more-comfortable user experience. It is noted, however, that other types of headphones may be utilized and are considered to be within the scope of the disclosure. Each ear bud 12 may include an audio output device, such as a speaker or the like. The headphone 10 further includes an audio input device, such as one or more microphones 14 operative to obtain sound from the ambient environment. As described in further detail below, the headphone 10 includes a controller that implements a sound masking method in accordance with the disclosure.

Figure 2:
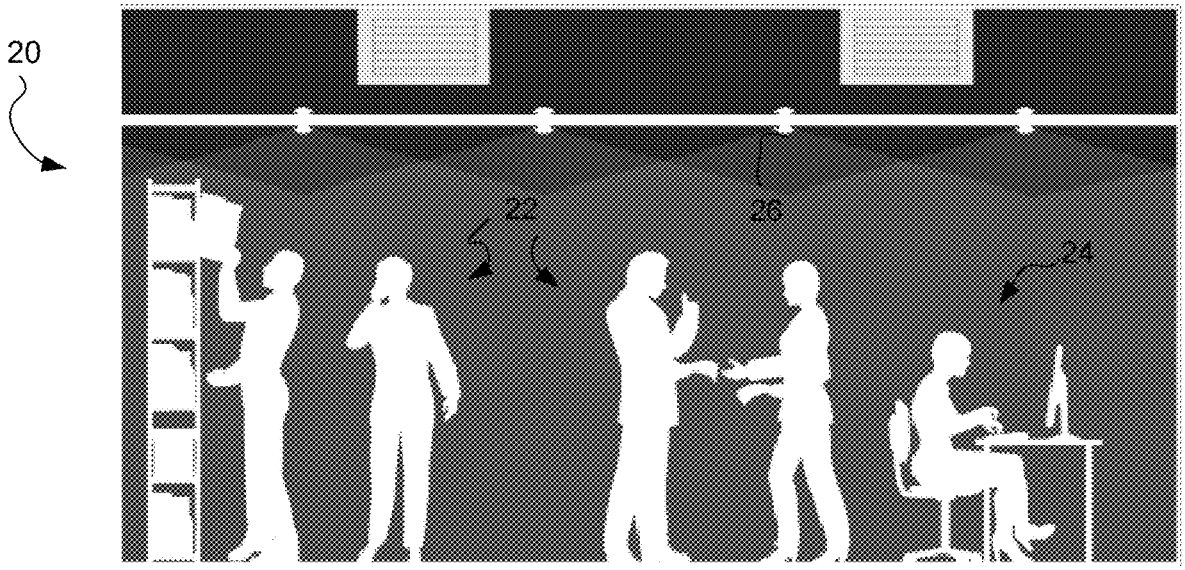
FIG. 2 illustrates an example office environment to which principles of the disclosure may be applied.

With additional reference to FIG. 2, noise in an office environment 20 (e.g., an ambient environment), such as a group of coworkers 22 talking in a vicinity of another coworker 24 who is in deep thought, can distract the coworker 24. In accordance with the present disclosure, the "noise" created by the group of coworkers 22 is recorded in real time by the audio input device 14 and analyzed in terms of spectrum vs. time.

Figure 3A:
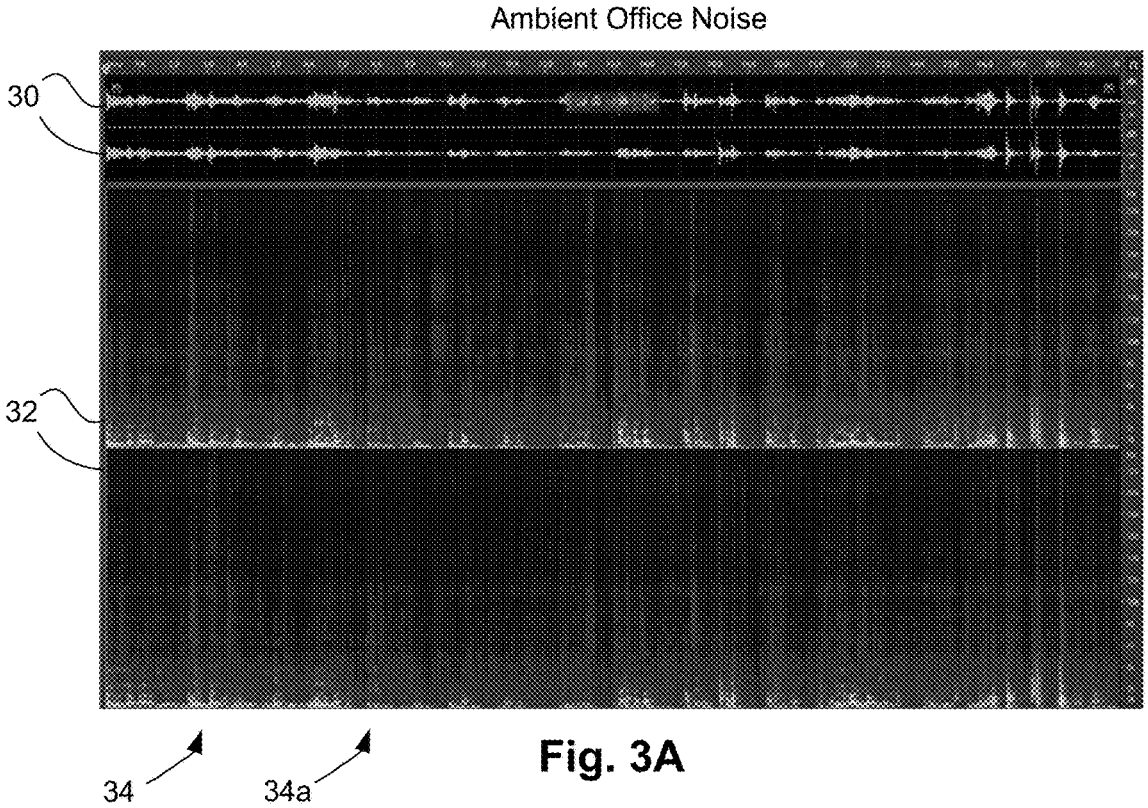
FIG. 3A is a spectrogram (FFT vs. time) of office landscape noise (binaural recording in a call center).
Figure 3B:
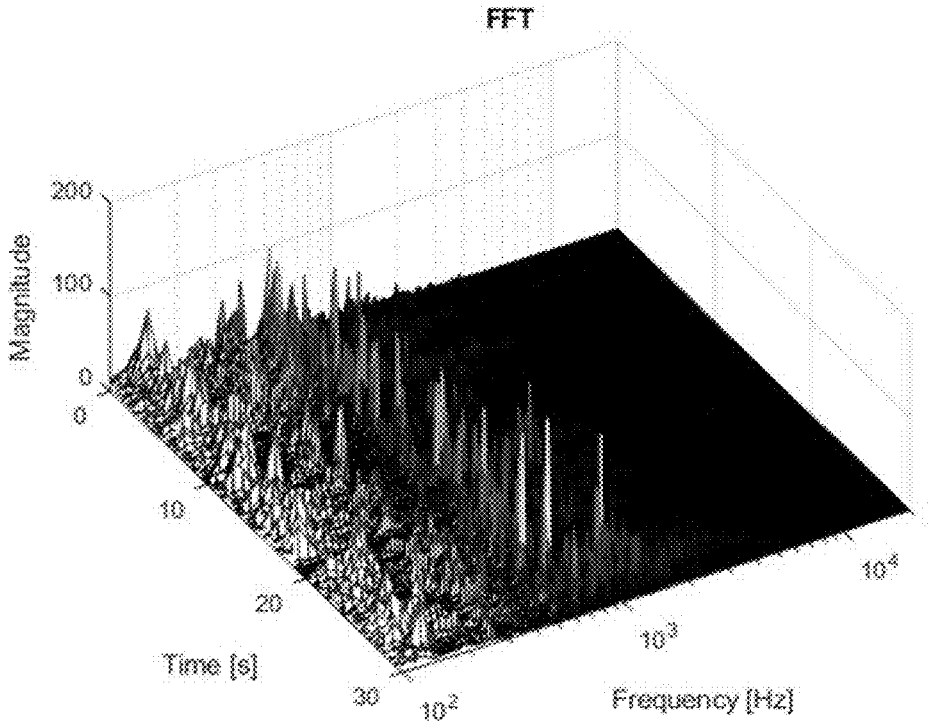
FIG. 3B is a three-dimensional plot of FIG. 3A.
Figure 3C:
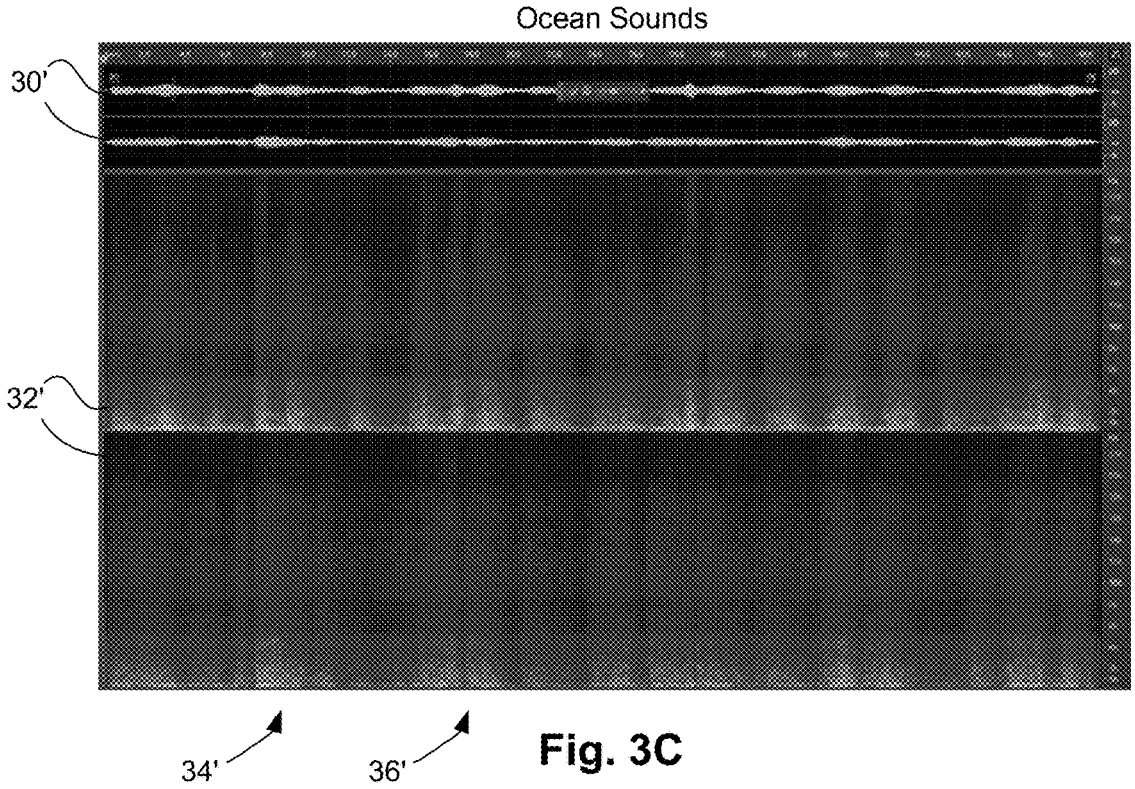
FIG. 3C is a spectrogram (FFT vs. time) of ocean waves (binaural recordings).
Figure 3D:
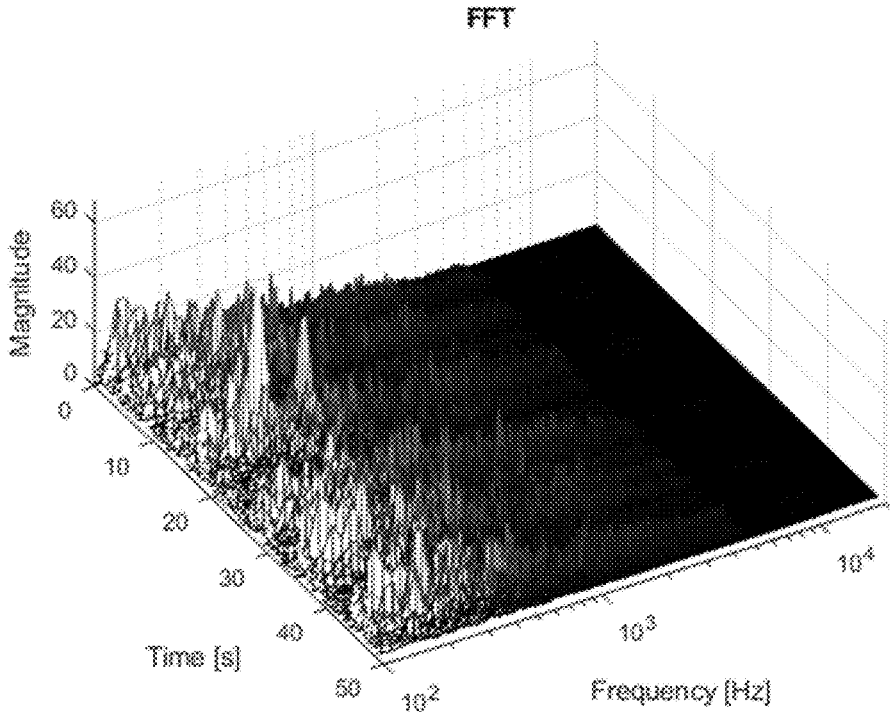
FIG. 3D is a three-dimensional plot of FIG. 3C.

FIGS. 3A and 3B illustrate an example spectrogram (FFT vs. time and 3D plot, respectively) of an office environment, and the illustrated information can be used to identify pre-recorded sounds that have similar spectral characteristics. More specifically, spectra vs. time for pre-recorded masking sounds are searched for a best match to the current acoustic spectra of the ambient environment. FIGS. 3C and 3D illustrate an example spectrogram (FFT vs. time and 3D plot, respectively) of a pre-recorded sound (e.g., ocean waves) that closely matches the spectra of the noise in the ambient environment. An upper portion of FIGS. 3A and 3C illustrate a normal sound recording 30, 30', showing the amplitude of the sound with respect to time. Two recordings are present in FIGS. 3A and 3C due to the binaural capture of the sound. Below the amplitude vs. time representation of sound 30, 30' is an illustration of the same sound, but instead of basing the illustration on sound amplitude vs. time, frequency vs. time 32, 32' is utilized to illustrate characteristics of the sound. Again, two representations are shown due to binaural capture of the sound. As seen in FIG. 3A, the frequency content 34, 34*a* of the office noise is significantly shifted from the frequency content 34', 34*a'* of the ocean waves of FIG. 3C. This shift in frequency provides a masking effect to the ambient noise.

In determining the best match, conventional techniques, such as minimum square error of the power spectrum (allowing for translation due to arbitrary gain) can be utilized. Based on the best match, at least one pre-recorded sound is identified for playback, although more than one may be identified if desired. At least a portion of the pre-recorded sound having a spectrum that best matches the spectrum of the ambient noise then is selected and played back, for example, through the audio output device 12 of the headphones 10 or via speakers 26 arranged in the ambient environment, to mask the noise in the ambient environment. To ensure smooth transitions between periods of noise and no noise, cross-fading can be applied to the selected pre-recorded sound, the sound level may be adjusted, and/or looping of the pre-recorded sound may be employed.

In performing the search for the best match, the spectra for the pre-recorded sounds may be predetermined and stored in a database. An advantage of predetermining the spectra of the available sounds is that such analysis need not be performed in real time and therefore the processing power for implementing the method can be minimized. However, it is contemplated that the spectral analysis of the sound could be performed in real time, provided that the analysis does not introduce a significant delay in retrieving and outputting the pre-recorded sound. With that in mind, the reaction time of the system should be fast enough to track the acoustic spectrum but slow enough to avoid annoying artifacts from the adaptation. Subjective testing may be implemented to determine the optimum reaction time. If too slow, the masking noise level may need to be raised to account for the louder moments. If too fast, the masking sound will sound modulated. Additionally or alternatively, analysis may be performed in the background. For example, if a situation is presented in which new sound files are desired that have not previously been included in the analyzed sound store, then the new sound files can be analyzed as a background operation and the characteristics of the sound file stored for later retrieval and use.

After finding the best matching masking sound at a given time, the spectral shape of the masking sound can be adjusted using, for example, a filter ("equalizer"). More specifically, the spectral shape of the masking sound can be tuned to match a desired spectrum, e.g., to match the spectrum of the ambient noise. In this regard, consideration should be given to the adjustments to avoid the masking sound being perceived as unnatural.

Figure 4A:
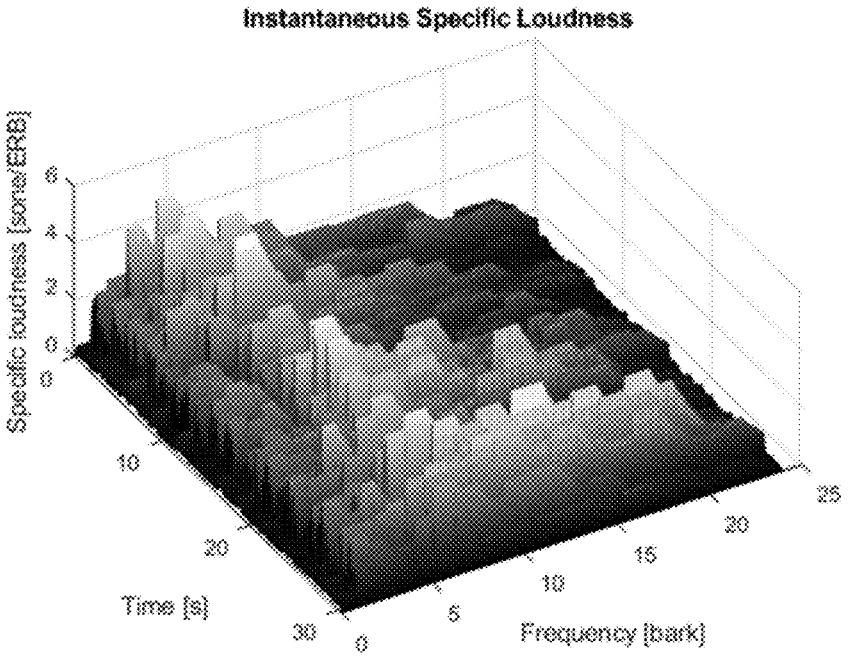
FIG. 4A illustrates spectrum vs. time in critical band representation (including masking effects) for an office landscape noise (binaural recording left channel).
Figure 4B:
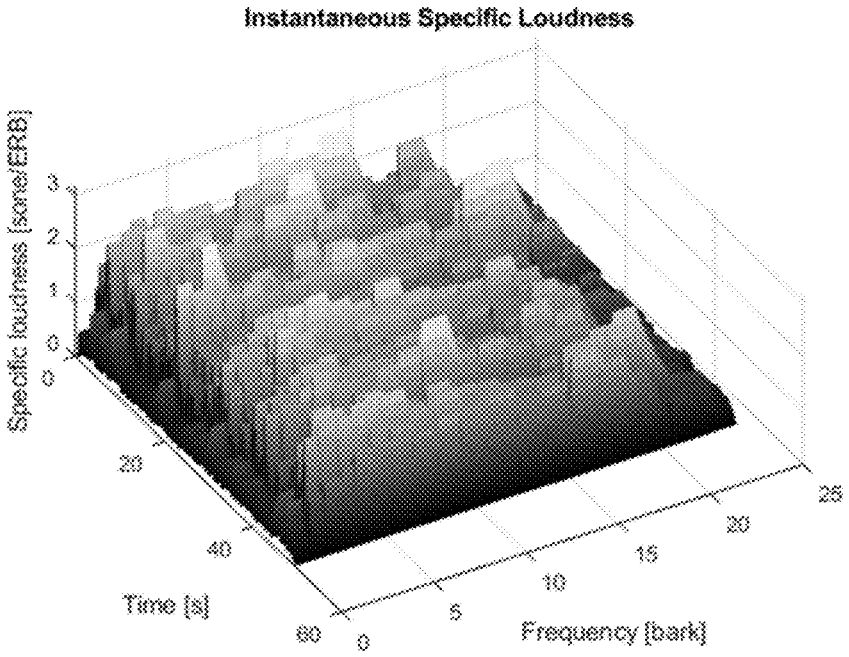
FIG. 4B illustrates spectrum vs. time in critical band representation (including masking effects) for ocean waves (binaural recording left channel).

Results of an example masking in accordance with the disclosure are illustrated in FIGS. 4A-4B. FIGS. 4A and 4B are graphical representations in frequency domain in critical band representation illustrated in terms of instantaneous specific loudness, where both figures include office noise combined with the masking sound. As seen in FIG. 4A, there are locations (e.g., around 25 seconds) where the frequency content is much wider than other portions. This wider portion corresponds to FIG. 3A, and demonstrates that the masking is following the frequency content of the office landscape in time. FIG. 4B illustrates that the addition of the masker results in a representation that resembles the ocean wave sound ("white noise").

The pre-recorded sounds may be obtained from a database of real sound recordings, where the sound recordings form potential masking sounds. Such sound recordings may be obtained, for example, from various sound stores including, but not limited to, media services providers such as audio streaming platforms like SPOTIFY, SOUNDCLOUD, APPLE MUSIC, etc.; video sharing platforms like YOUTUBE, VIMEO, etc.; or other like services in which a suitable portion of the contents can be pre-analyzed, for example, in terms of spectrum versus time. As noted, the results of the analysis can be stored for later retrieval.

In case the masking noise is presented using headphones, it may be that the sound stores are collected utilizing binaural recording methods. Binaural recording methods are advantageous as reproduced sound creates natural cues to the brain. More specifically, when listening to binaural recordings with headphones the auditory cues "make sense" to the brain, as they are consistent with every-day auditory cues. Such recordings may produce a more relaxing listening experience due to their natural sound. However, if the binaural recording has an interesting sound component it may cause the listener to believe the sound is real, which could create distractions that cause the listener to turn his/her head to where the sound appears to originate. If the spatial cues in the binaural recordings do cause distractions, other recordings can also be used as well as artificially created sounds (mono or stereo).

For example, a long binaural recording of ocean waves at a beach or running water stream can be used as the pre-recorded sound. Such sound has calm portions and more intense portions. When noise is detected in the ambient environment, an intense portion of the pre-recorded sound can be faded in. As noted above, one criterion for the pre-recorded sound is that it matches the acoustic spectrum of the ambient sound. A secondary criterion may be that there is sufficient energy in the 1-4 kHz area (which is most important for speech intelligibility), since consonants containing these frequencies are expected to turn up during any speech utterance. The listener may not even notice the adaptation, and only perceive natural variation in the intensity of the ocean waves.

In one embodiment, spectral characteristics of sound in the ambient environment are determined in terms of auditory excitation patterns (or cochlear excitation patterns), using a hearing model. The human auditory system includes the outer, middle and inner ear, auditory nerve and brain. The basilar membrane in the inner ear works as a frequency analyzer and its physical behavior can explain psychoacoustic phenomena like frequency masking. The basilar membrane causes, via the organ of corti, neurons to fire into the auditory nerve. The average neural activity in response to a sound as a function of frequency can be called an excitation pattern.

The human auditory system can be modeled with a hearing model. Although a detailed physical model could be made, it is in some applications sufficient with a simplified approach, e.g., to divide the sound into frequency bands (sometimes known as critical bands), apply non-linear gains to each band and introduce a dependency on adjacent bands to account for frequency masking. The result is a modelled auditory excitation pattern.

For example, a critical band excitation may be defined in terms of specific loudness (critical band excitation), and a model may be used to iteratively determine a gain and/or filter that produces critical band excitation. The model can account for spectral and optionally temporal masking. Such models are available, for example, in loudness models such as ISO 532 and ANSI S3.4 series. In principle, perceived sound can be modeled using filters which account for body reflections, outer and middle ear followed by a filter bank followed by non-linear detection and some "spill-over" between bands to account for spectral masking. In some cases, such models also account for temporal masking.

If the device and method does not manage to mask the first utterances in a conversation, there is the possibility to mask the remaining portions of the conversation. In this regard, another embodiment of the disclosure predicts future spectral characteristics of the noise in the ambient environment based on the spectral characteristics of previously-collected noise in the ambient environment. The step of predicting may include, for example, using a history of the ambient noise collected over a predefined interval to perform the prediction. A few seconds into a conversation, the speaker's spectral characteristics and levels have been collected, and this can serve as a prediction of which masker will be appropriate in the near future. In particular, the maximum excitation in frequency areas of importance for intelligibility may be considered. The future spectral characteristics of the noise can be used to search a database of pre-recorded sounds in order to identify one or more pre-recorded sounds that have spectral characteristics corresponding to the future characteristics of the sound. At least a portion of the one or more identified pre-recorded sounds that correspond to the future spectral characteristics then are reproduced to mask the sound in the ambient environment.

If the spectral similarity is compared in terms critical band excitation, the result can be powerful in terms of the ability to predict auditory masking. Loudness is inherently non-linear and thus the result depends on the absolute level of the noise. Therefore, it is possible to fine-tune the masking prediction by iteratively finding the gain that produces a critical band excitation which will be sufficient to mask the acoustic noise, avoiding "overkill" by applying unnecessarily high gain of the masking noise.

In iteratively finding the gain, the critical band excitation of the ambient noise can be calculated. In a first step, the recorded noise database is analyzed and auditory excitation patterns versus time are stored. As human hearing is non-linear, a certain absolute acoustic presentation level should be assumed in this step. Alternatively, data is stored for multiple acoustic presentation levels. In a second step, the ambient noise is analyzed in terms of auditory excitation patterns and the database is searched in terms of pattern similarity with the ambient noise. A masker then is selected. The hearing model may then be further used to fine-tune the level of masker and/or a filter. Complete masking or partial masking may be targeted/achieved. The amount of masking can be predicted by 1) using the pre-calculated excitation pattern from the masker alone or re-calculating the pre-calculated excitation pattern based on modified level/filter, 2) calculating the excitation pattern from the mix of masker and ambient noise, 3) calculating the difference between the two excitation patterns. If the two cases are similar, the ambient noise is essentially not contributing to the excitation and thus masking or partial masking is achieved. If the masking is not considered successful, the process is repeated with an adjustment to the critical band and/or the gain of the masker sound until masking or partial masking is achieved by the desired amount (which will make the masker sound efficient but not unnecessarily loud).

An advantage of this methodology is the ability to predict auditory masking is enhanced. More particularly, if only the similarity of the spectrum (e.g., an FFT or fractional-octave band analysis) is analyzed, then masking effects are not captured nor are the level and frequency dependent sensitivity. For example, to "upwards masking", a masking noise containing a pure tone of 1000 Hz at 80 dBSPL will function as a masker for ambient noise of 1100 Hz at 80-X dBSPL as well as ambient noise of 2000 Hz at 80-Y dBSPL etc.

Figure 5:
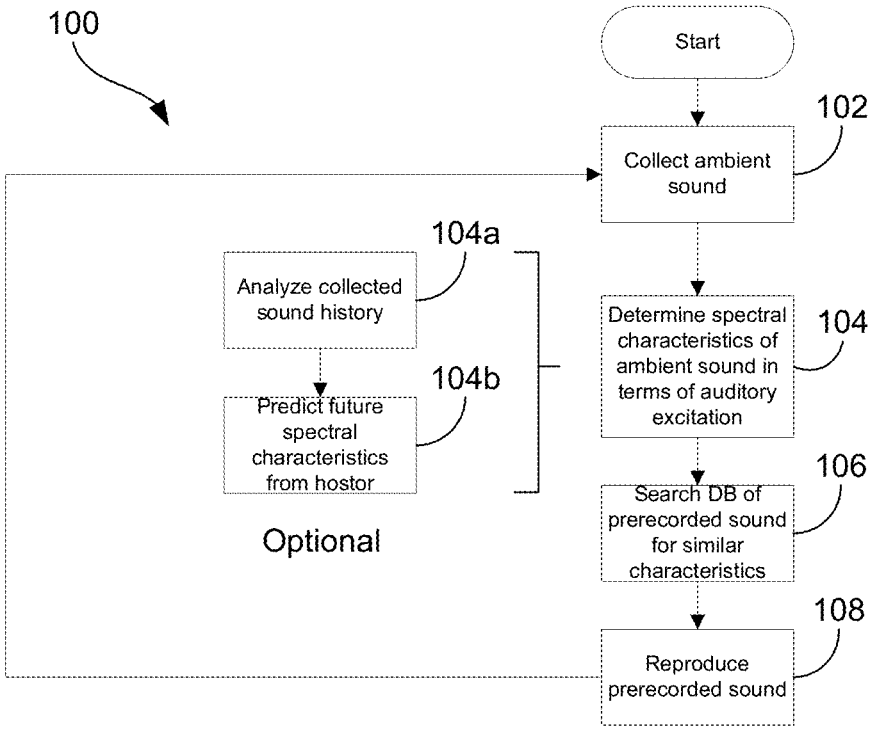
FIG. 5 is a flow diagram illustrating example steps of a method in accordance with the disclosure.

Moving now to FIG. 5, illustrated is a flow chart 100 that provides example steps for generating a sound masker in accordance with the disclosure. The flow chart 100 includes a number of process blocks arranged in a particular order. As should be appreciated, many alternatives and equivalents to the illustrated steps may exist and such alternatives and equivalents are intended to fall with the scope of the claims appended hereto. Alternatives may involve carrying out additional steps or actions not specifically recited and/or shown, carrying out steps or actions in a different order from that recited and/or shown, and/or omitting recited and/or shown steps. Alternatives also include carrying out steps or actions concurrently or with partial concurrence.

Beginning at step 102, sound in the ambient environment is collected, for example, using an audio input device 16 (e.g., a microphone of the headphone 10, a microphone of a computer, a microphone worn by the user, etc.). Next at step 104 spectral analysis is performed to determine spectral characteristics of the of the collected sound in terms of auditory excitation. Further, and as discussed above, a critical band excitation may be defined in terms of specific loudness and a model may be used to iteratively determine a gain that produces critical band excitation.

Optionally, the determining step 104 may include a prediction step that predicts spectral characteristics of future sound. Such prediction may be based on ambient sound previously collected over a predefined interval, as indicated in steps 104*a* and 104*b*

Next at step 106, a search is performed in a database of pre-recorded sounds to identify any pre-recorded sounds that have spectral characteristics that are similar to those of the collected ambient sound. Such searching can include, for example, obtaining spectral characteristics of the pre-recorded sound and comparing the spectral characteristics of the pre-recorded sound to the spectral characteristics of the sound in the ambient environment. The database of pre-recorded sound may include a database that stores pre-recorded music (e.g., a subscription or free music service) or pre-recorded nature sounds.

Upon finding a best match to the spectral characteristics of the collected ambient sound, at step 108 the best-matching sound is output by the audio output device 12 (e.g., speakers in the form of an ear bud, speakers arranged on a desk top or mounted to a support structure, etc.). An output level of pre-recorded sound may be adjusted to produce partial or full masking of the sound in the ambient environment. Further, a spectral shape of the pre-recorded sound may be adjusted to match a spectrum of the collected ambient sound. Also, a noise-canceling function may also be implemented to further enhance the overall effect of the system. The method then may move back to step 102 and repeat.

FIG. 5 described above depicts an example flow diagram representative of sound masking process that may be implemented using, for example, computer readable instructions that may be used to mask sound in the ambient environment. The example process may be performed using a processor, a controller and/or any other suitable processing device. For example, the example process may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Some or all of the example process may be implemented using any combination(s) of application specific integrated circuit(s) (ASIC(s)), programmable logic device(s) (PLD(s)), field programmable logic device(s) (FPLD(s)), discrete logic, hardware, firmware, and so on. For example, the order of execution of the blocks may be changed, and/or some of the blocks described may be changed, eliminated, sub-divided, or combined. Additionally, any or all of the example process may be performed sequentially and/or in parallel by, for example, separate processing threads, processors, devices, discrete logic, circuits, and so on.

Figure 6:
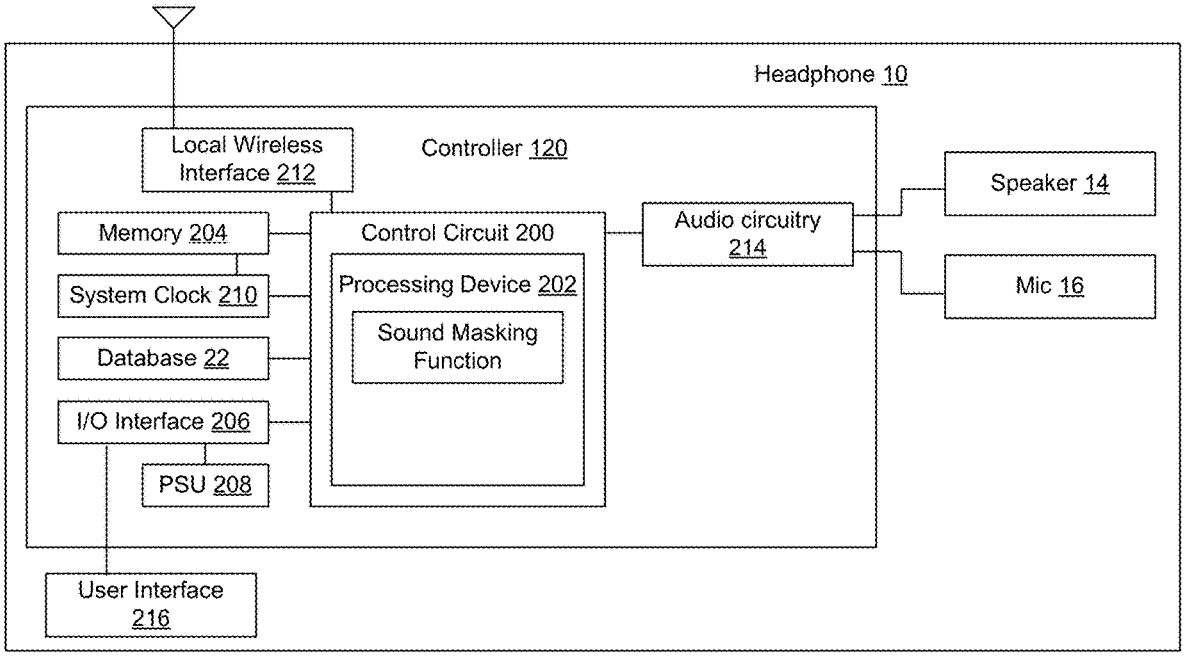
FIG. 6 is a block diagram of an example device in accordance with the disclosure.

The above-described sound masking process may be performed by a controller 120 of the headphone 10, an example block diagram of the headphone 10 being illustrated in FIG. 6. As previously noted, the headphone 10 includes a controller 120 having an acoustic engine configured to carry out the noise masking method described herein. Although discussed in terms of the headphone 10, it should be understood that any output device such as speaker 26 in FIG. 2 may be coupled to the controller 120 having the acoustic engine configured to carry out the noise masking method described herein. One of ordinary skill in the art would recognize many variations, modifications, and alternatives The controller 120 may include a primary control circuit 200 that is configured to carry out overall control of the functions and operations of the noise masking method 100 described herein. The control circuit 200 may include a processing device 202, such as a central processing unit (CPU), microcontroller or microprocessor. The processing device 202 executes code stored in a memory (not shown) within the control circuit 200 and/or in a separate memory, such as the memory 204, in order to carry out operation of the controller 120. For instance, the processing device 202 may execute code that implements the noise masking method 100. The memory 204 may be, for example, one or more of a buffer, a flash memory, a hard drive, a removable media, a volatile memory, a non-volatile memory, a random-access memory (RAM), or other suitable device. In a typical arrangement, the memory 204 may include a non-volatile memory for long term data storage and a volatile memory that functions as system memory for the control circuit 200. The memory 204 may exchange data with the control circuit 200 over a data bus. Accompanying control lines and an address bus between the memory 204 and the control circuit 200 also may be present.

The controller 120 may further include one or more input/output (I/O) interface(s) 206. The I/O interface(s) 206 may be in the form of typical I/O interfaces and may include one or more electrical connectors. The I/O interface(s) 206 may form one or more data ports for connecting the controller 200 to another device (e.g., a computer) or an accessory via a cable. Further, operating power may be received over the I/O interface(s) 206 and power to charge a battery of a power supply unit (PSU) 208 within the controller 120 may be received over the I/O interface(s) 206. The PSU 208 may supply power to operate the controller 120 in the absence of an external power source.

The controller 120 also may include various other components. For instance, a system clock 210 may clock components such as the control circuit 200 and the memory 204. A local wireless interface 212, such as an infrared transceiver and/or an RF transceiver (e.g., a Bluetooth chipset) may be used to establish communication with a nearby device, such as a radio terminal, a computer or other device.

The controller 120 also includes audio circuitry 214 for interfacing with the audio input device (microphone 16) and audio output device (speakers/ear buds 14). As described herein, ambient sound is collected by the audio input devices, analyzed to determine a masking sound, and the masking sound is output by the speakers 14. A user interface device 216 provides a means for a user to adjust settings of the headphone 10 (e.g., volume, power on/off, etc.).

It is notated that while the speaker 14 and microphone 16 are shown as part of the headphone 10, this is merely an example. In some embodiments the speaker 14 and/or microphone 16 may be remotely located. For example, when the device is in the form of a personal computer (PC), the speakers may be located in the ceiling and (wired or wirelessly) connected to a PC located on a desk of the user. Similarly, the microphone 16 may be worn by the user and (wired or wirelessly) connected to a remotely located PC.

Although the disclosure has been shown and described with respect to a certain embodiments, it is obvious that equivalent alterations and modifications will occur to others skilled in the art upon the reading and understanding of this specification and the annexed drawings. In particular regard to the various functions performed by the above described components, the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the disclosure. In addition, while a particular feature of the disclosure can have been disclosed with respect to only one of the several embodiments, such feature can be combined with one or more other features of the other embodiments as may be desired and advantageous for any given or particular application.

What is claimed is:

1. A method of generating a sound masker, comprising:

determining spectral characteristics of sound in the ambient environment, wherein said spectral characteristics are determined in terms of auditory excitation patterns;

predicting future spectral characteristics of the sound in the ambient environment based on the determined spectral characteristics;

searching a database of pre-recorded sounds to identify a first pre-recorded sound that has spectral characteristics corresponding to the spectral characteristics of the sound in the ambient environment and a second pre-recorded sound that has spectral characteristics corresponding to the predicted future spectral characteristics of the sound; and reproducing at least a portion of at least one of the first pre-recorded sound and the second pre-recorded sound to mask the sound in the ambient environment.

2. The method according to claim 1, wherein determining the spectral characteristics in terms of auditory excitation patterns includes using a hearing model and iteratively finding a gain that produces critical band excitation.

3. The method according to claim 1, wherein reproducing the at least one of the first pre-recorded sound and the second pre-recorded sound includes outputting the pre-recorded sound through speakers arranged in the ambient environment or through speakers of a headphone.

4. The method according to claim 1, further comprising implementing at least one of looping of the identified at least one of the first pre-recorded sound and the second pre-recorded sound, cross-fading of the identified at least one of the first pre-recorded sound and the second pre-recorded sound, or level adjustment of the at least one of the first pre-recorded sound and the second pre-recorded sound.

5. The method according to claim 1, further comprising adjusting an output level of the identified at least one of the first pre-recorded sound and the second pre-recorded sound to produce partial or full masking of the sound in the ambient environment.

6. The method according to claim 1, wherein predicting includes basing the prediction on ambient sound collected over a predefined interval.

7. The method according to claim 1, wherein determining spectral characteristics of the sound in the ambient environment comprises determining the spectral characteristics based on spectral analysis of the sound in the ambient environment.

8. The method according to claim 1, wherein searching includes obtaining spectral characteristics of the pre-recorded sound and comparing the spectral characteristics of the pre-recorded sound to the spectral characteristics of the sound in the ambient environment.

9. The method according to claim 1, wherein searching the database comprises searching a database that includes at least one of pre-recorded music or pre-recorded nature sounds.

10. The method according to claim 1, further comprising adjusting a spectral shape of at least one of the first pre-recorded sound and the second pre-recorded sound to match a target spectrum.

11. A device for masking sound in the ambient environment, comprising:

at least one audio input device operative to record sound from the ambient environment;

a controller operatively coupled to the at least one audio input device, the controller configured to:

determine spectral characteristics of sound in the ambient environment collected by the at least one audio input device, wherein said spectral characteristics are determined in terms of auditory excitation patterns;

predict future spectral characteristics of the sound in the ambient environment based on the determined spectral characteristics; and search a database of pre-recorded sounds to identify at least one of a first pre-recorded sound that has spectral characteristics corresponding to the spectral characteristics of the sound in the ambient environment and a second pre-recorded sound that has spectral characteristics corresponding to the predicted future spectral characteristics of the sound.

12. The device according to claim 11, wherein the controller is configured to determine the spectral characteristics in terms of auditory excitation patterns using a hearing model and an iteratively found gain that produces critical band excitation.

13. The device according to claim 11, further comprising at least one audio output device operatively coupled to the controller and operative to output sound, wherein the controller is configured to use the at least one audio output device to reproduce at least a portion of at least one of the first pre-recorded sound and the second pre-recorded sound to mask the sound in the ambient environment.

14. The device according to claim 11, wherein the controller is configured to base the prediction on ambient sound collected over a predefined interval.

15. The device according to claim 11, further comprising at least one audio output device operatively coupled to the controller and operative to output sound, wherein the controller is configured to use the at least one audio output device to reproduce at least a portion of at least one of the first pre-recorded sound and the second pre-recorded sound to mask the sound in the ambient environment.

16. The device according to claim 11, wherein the controller is configured to determine spectral characteristics of the collected sound based on spectral analysis of the collected ambient sound.

17. The device according to claim 11, wherein the controller is configured to implement cross-fading of at least one of the first pre-recorded sound and the second pre-recorded sound.

18. The device according to claim 11, wherein the controller is configured to adjust an output level of at least one of the first pre-recorded sound and the second pre-recorded sound to produce partial or full masking of the sound in the ambient environment.

19. The device according to claim 11, wherein the device comprises noise cancelling headphones.

20. The device according to claim 11, wherein the controller is configured to adjust a spectral shape of at least one of the first pre-recorded sound and the second pre-recorded sound to match a target spectrum.

* * * * *